US005139456A

United States Patent [19]

Chuang

[11] Patent Number: 5,139,456

[45] Date of Patent: Aug. 18, 1992

[54] GROUNDED TURNING AND ELEVATING TOY FLYING SAUCE

[76] Inventor: Chuan-Tien Chuang, No. 40, Lane 174, Ta Hsing Street, Tainan, Taiwan

[21] Appl. No.: 641,999

[22] Filed: Jan. 16, 1991

[51] Int. Cl.[5] ..... A63H 17/00

[52] U.S. Cl. ..... 446/231; 446/236; 446/489

[58] Field of Search ..... 446/231, 230, 232, 236, 446/237, 489, 491

[56] References Cited

U.S. PATENT DOCUMENTS 4,209,941 7/1980 Bourque ..... 446/231

FOREIGN PATENT DOCUMENTS 630644 6/1936 Fed. Rep. of Germany ..... 446/437

1261334 4/1961 France ..... 446/437

*Primary Examiner*—Mickey Yu

*Attorney, Agent, or Firm*—Varndell Legal Group

[57] ABSTRACT

A structurally simplified and diversified toy flying saucer is provided. The toy saucer includes a housing mounting therein a prime mover driving a reduction gear assembly, an elevating mechanism for elevating the housing, a turning mechanism for turning the housing, and a transmitting disk driven by the gear assembly and having thereon an irregular groove slidably receiving therein a slider connected to an oscillating piece which has a first end pivotally connected to the housing and a second end coupled to the elevating mechanism. The saucer can also be devised to have a sparkling illuminating medium and a vertically movable top cover.

5 Claims, 6 Drawing Sheets

GROUNDED TURNING AND ELEVATING TOY FLYING SAUCE

BACKGROUND OF THE INVENTION

The present invention relates to toy, and , more particularly, to a toy flying saucer.

The conventional toy flying saucers can be categorized into the stationary type and the movable type. The former is operated by the player's labor or a coiled spring and the latter is driven by a motor to move on a flat surface. Since a diversified toy is more enjoyable, it is, desired to provide a more diversified toy flying saucer.

SUMMARY OF THE INVENTION

It is therefore an object of the present invention to provide a diversified toy flying saucer having a vertically movable top cover, an openable side door, a vertically movable housing and a sparkling illuminating medium.

According to the present invention, a toy flying saucer includes a housing having mounted therein a prime mover driving a reduction gear assembly driving a transmitting disk having an irregular groove slidably receiving therein a slider, an elevating mechanism coupled to the gear assembly for elevating the housing, and an oscillating piece connecting thereto the slider and having a first end pivotally connected to the housing and a second opposite end mechanically coupled to the elevating mechanism.

The present invention may best be understood through the following description with reference to the accompanying drawings, in which:

DETAILED DESCRIPTION OF THE PREFERRED EMBODIMENT

Figure 1:
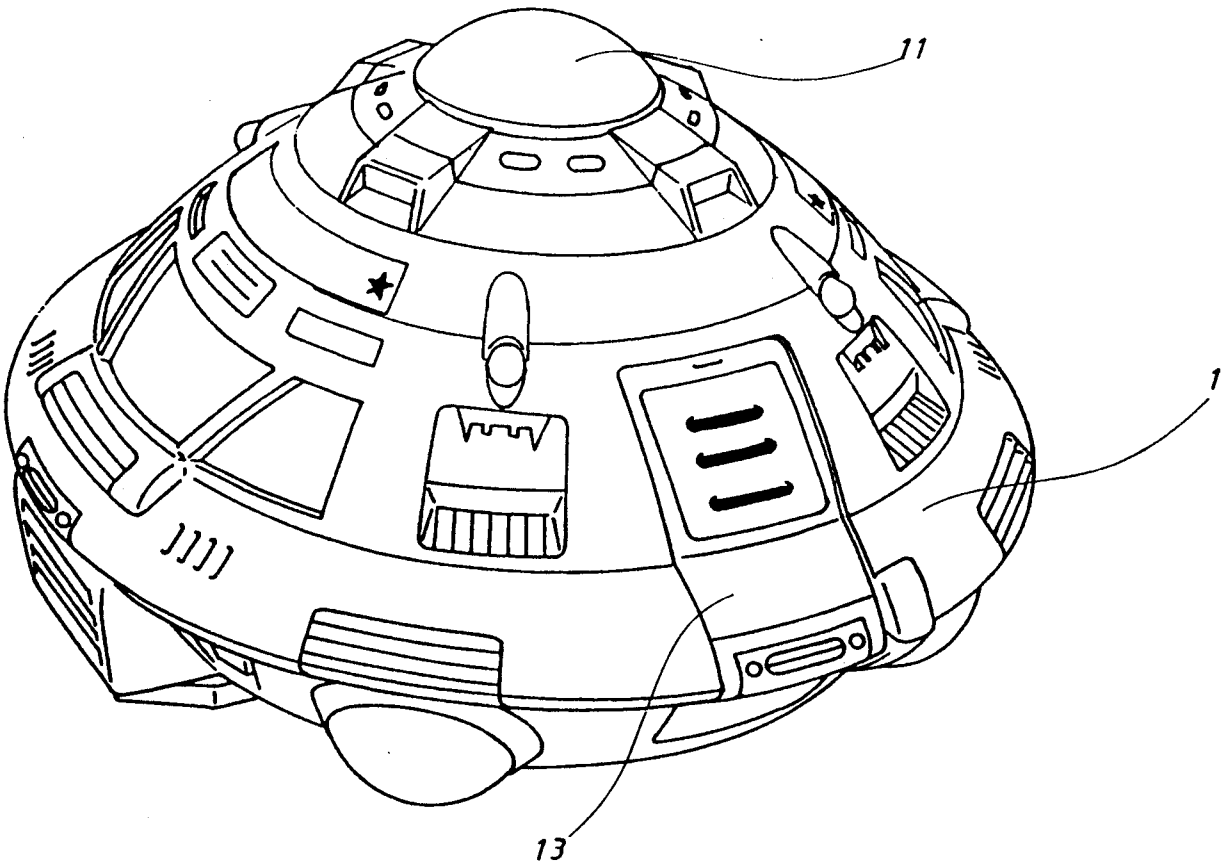
FIG. 1 is a perspective view showing a preferred embodiment of a toy flying saucer according to the present invention.
Figure 2:
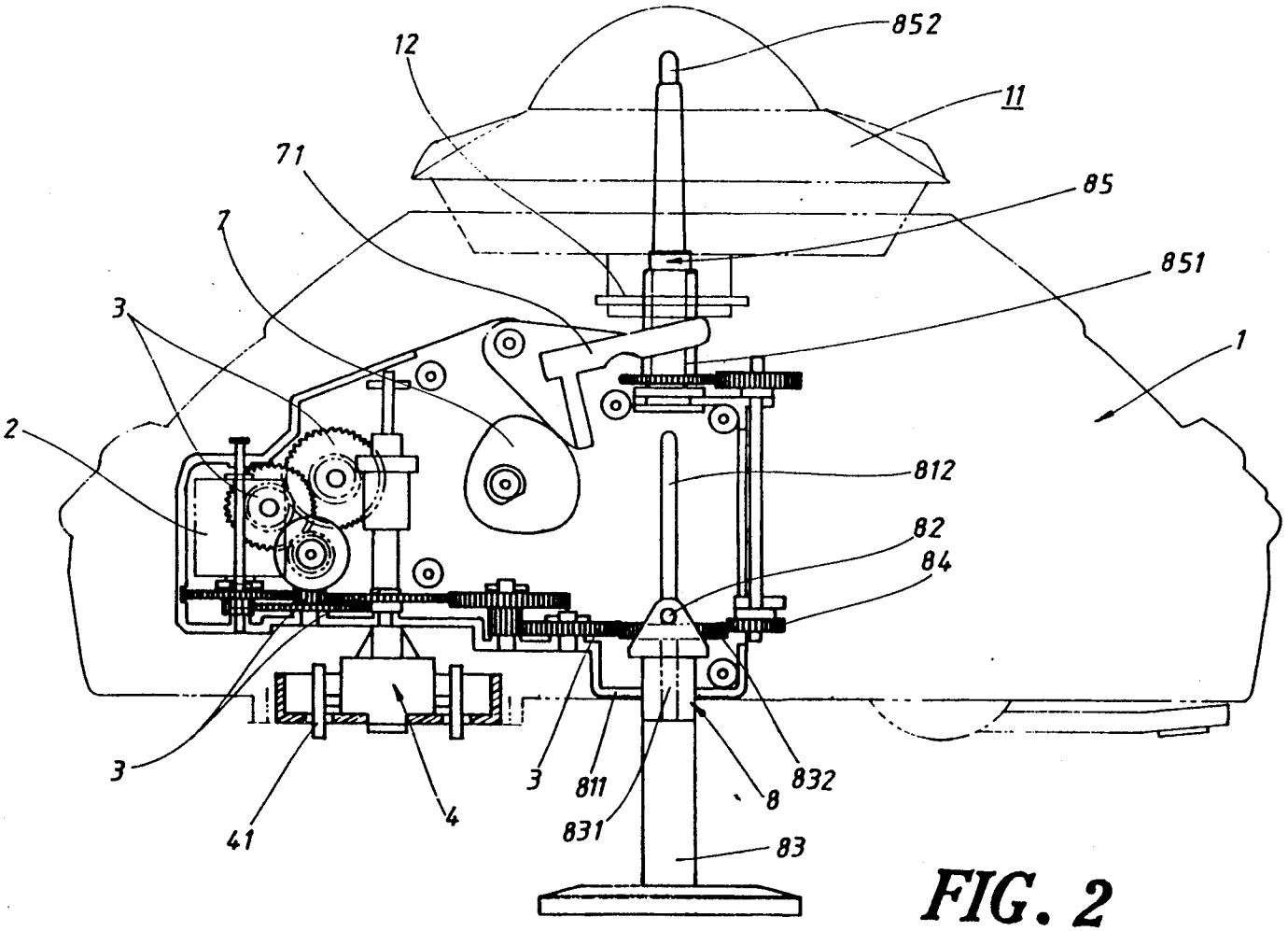
FIG. 2 is a schematically structural view showing that a top cover and an elevating mechanism of a toy flying saucer in FIG. 1 are operated.
Figure 3:
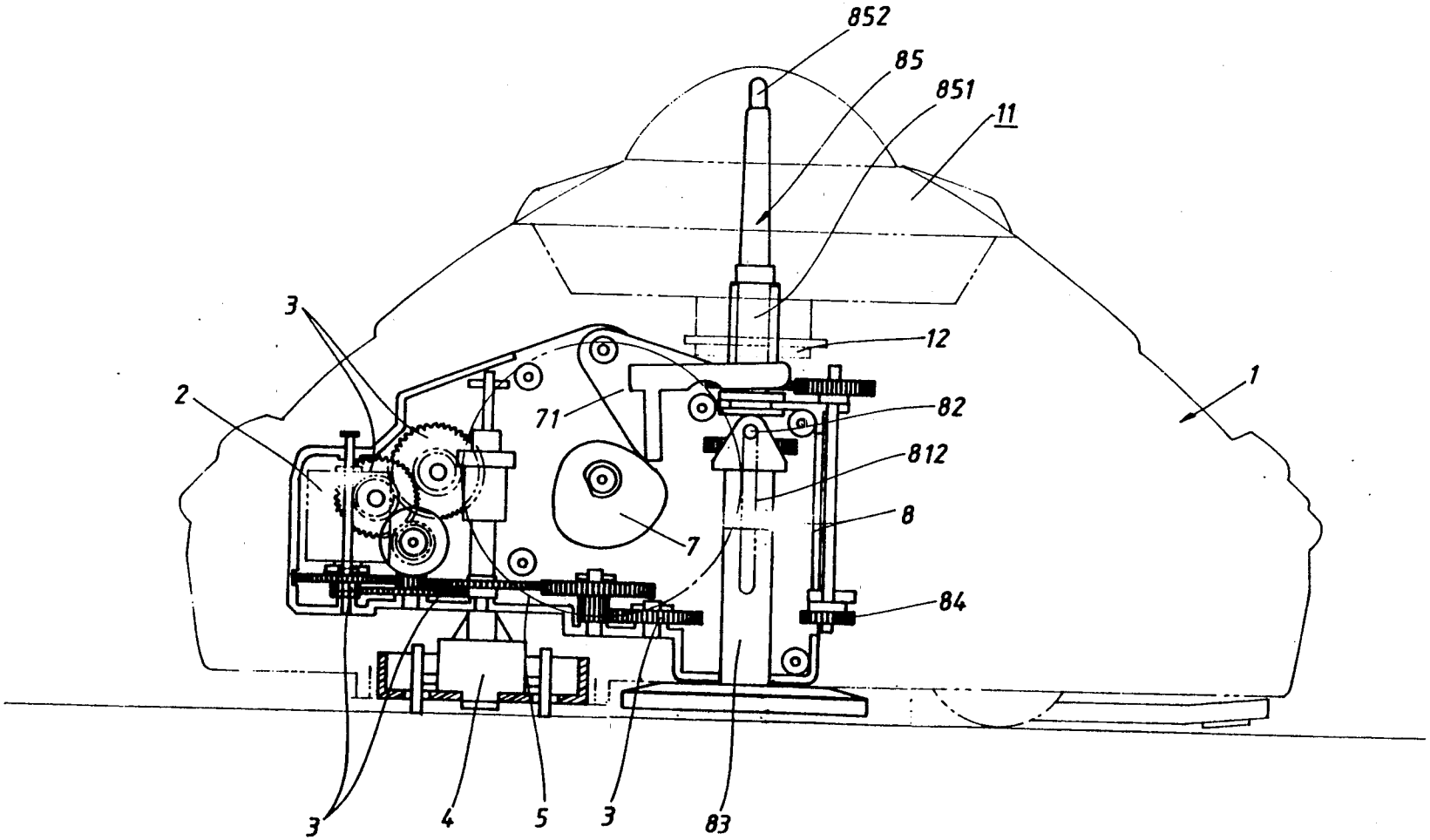
FIG. 3 is a schematically structural view showing that a top cover and an elevating mechanism are collapsed in a housing of a toy flying saucer in FIG. 1.

Referring now to FIGS. 1–6, a preferred embodiment of a toy flying saucer according to the present invention includes a housing 1 mounting therein a prime mover, e.g. a motor 2 driving a reduction gear assembly 3 driving a turning mechanism 4 having two coaxial wheels 41 protruding beyond housing 1 for turning housing 1, a transmitting disk 5 driven by gear assembly 3 and having thereon an irregular groove 51 slidably receiving therein a slider 61, an elevating mechanism 8 for elevating housing 1, and an oscillating piece 6 connecting thereto slider 61 and having a first end 62 pivotally connected to housing 1, a second hollow end 63 coupled to mechanism 8, and an extending actuating rod 64.

Figure 4:
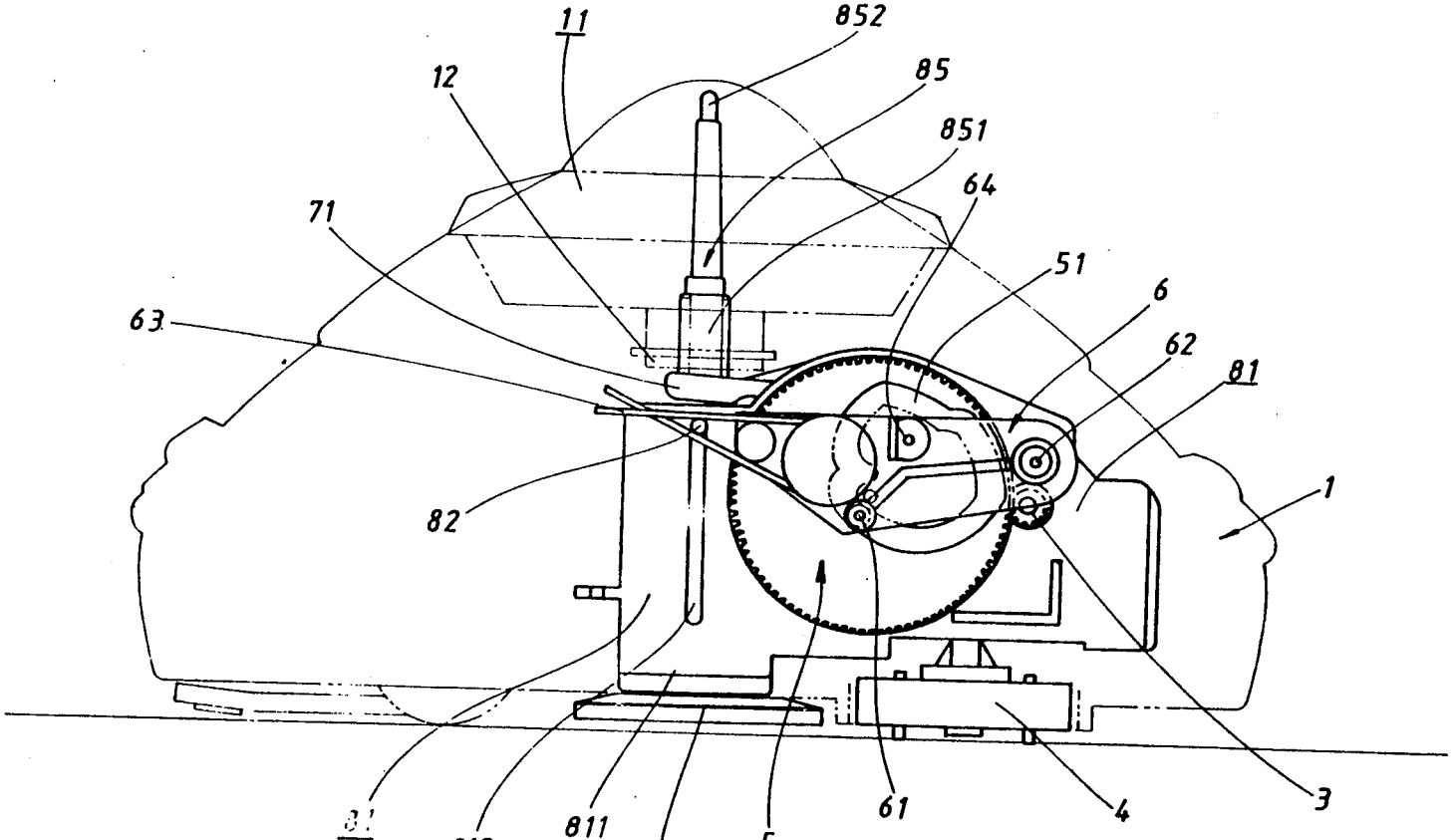
FIG. 4 is a schematically structural view showing a transmitting disk in a toy flying saucer in FIG. 1.
Figure 5:
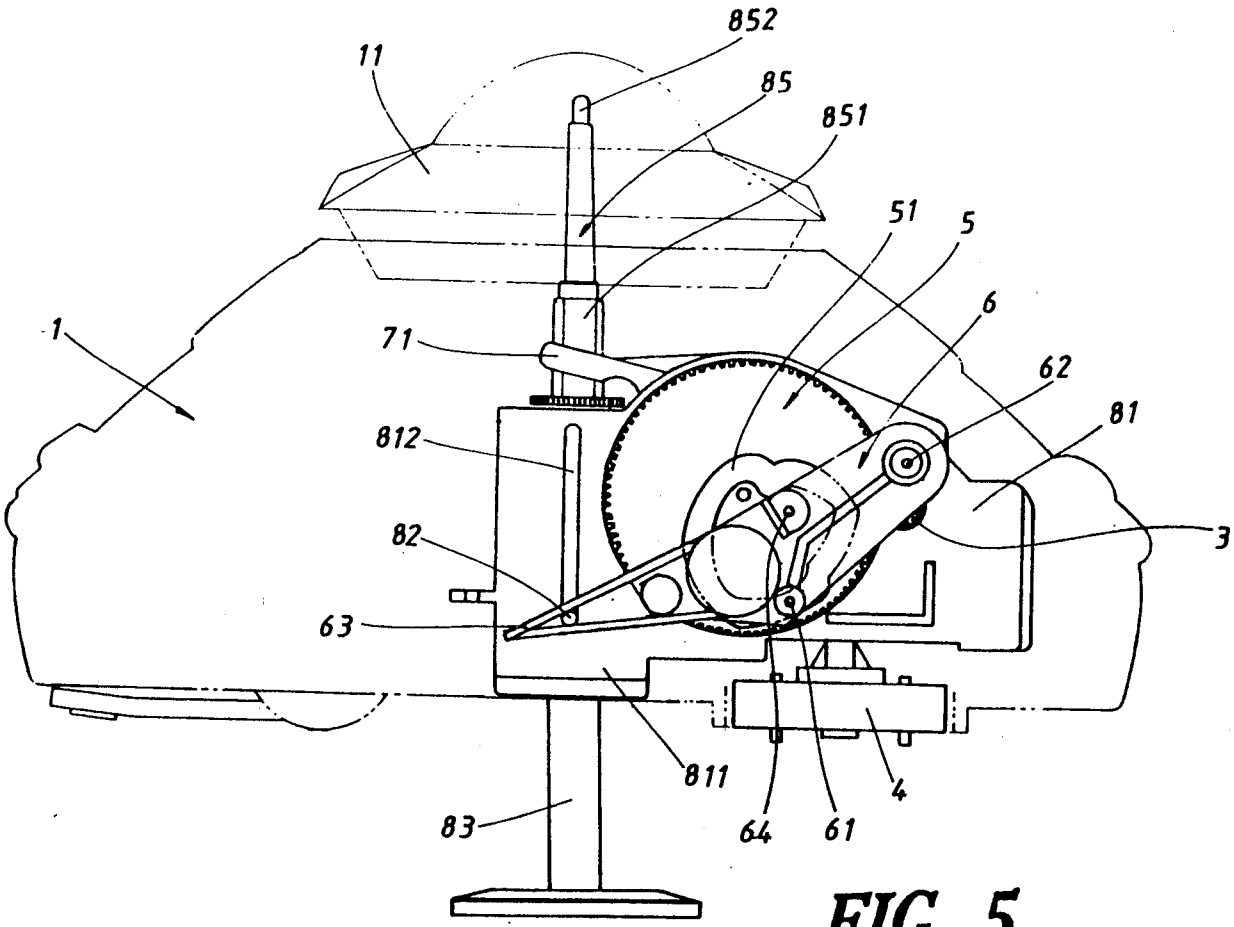
FIG. 5 is similar to FIG. 4 but has the oscillating piece therein downwardly pivoted.
Figure 6:
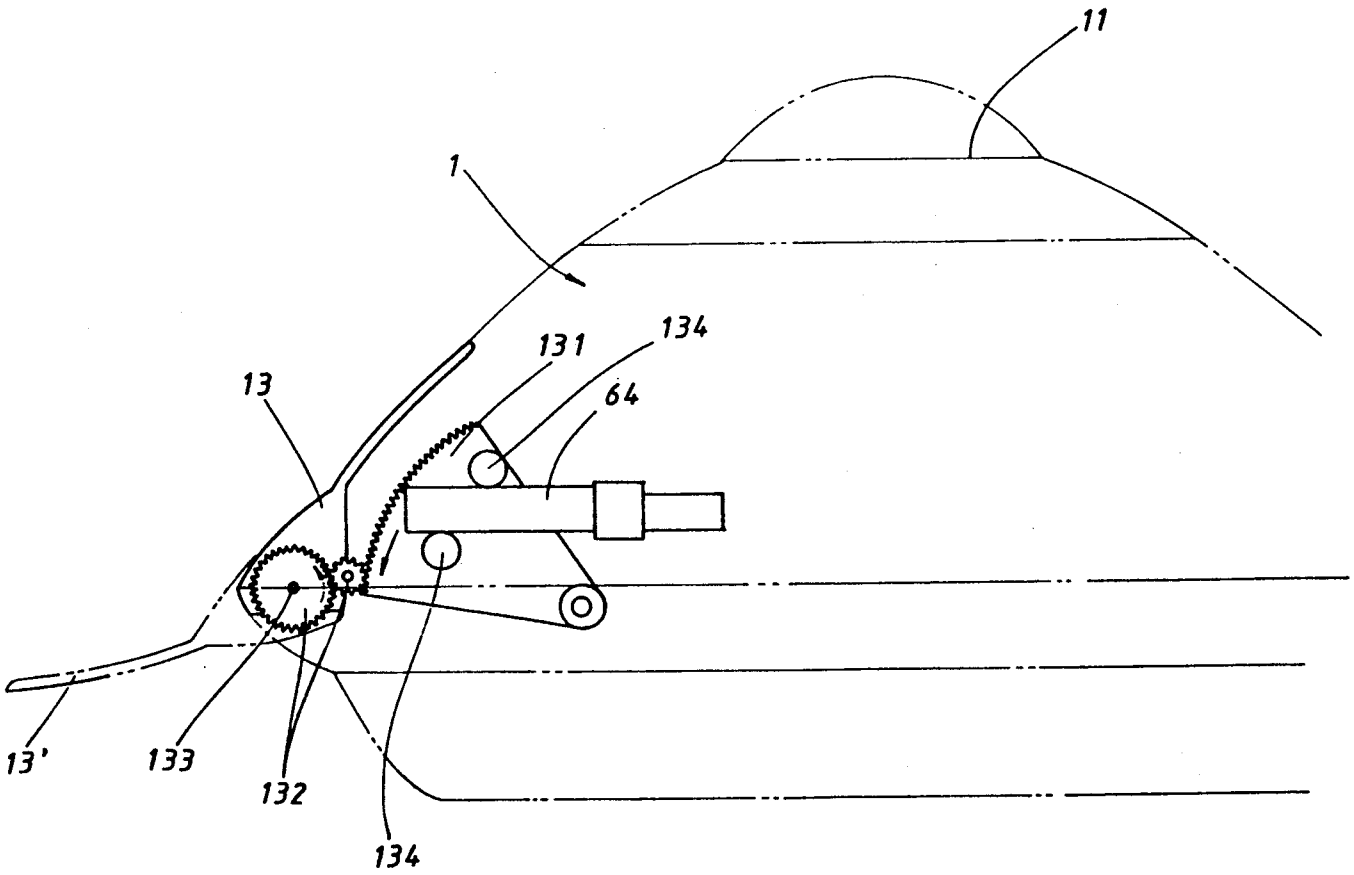
FIG. 6 is a schematically structural view showing an opened side door of a toy flying saucer in FIG. 1.

Housing 1 forms thereon an openable side door 13 and mounts therein a gear train 131, 132 respectively pivotally connected to side door 13 by a pivoting pin 133 fixed to door 13 and to actuating rod 64 by two positioning pins 134 which are secured to sectoral gear 131 and mount therebetween actuating rod 64 so that when oscillating piece 6 oscillates, actuating rod 64 can alternatively open and close side door 13. As seen in FIGS. 4 and 5, actuating rod 64 has one end thereof fixed to oscillating piece 6, the actuating rod 64 extending perpendicular to the oscillating piece, or extending upwardly from the plane of the paper as seen in these two figures. As seen in FIG. 6, the outer end of actuating rod 64 is disposed between two positioning pins 134 secured to sectoral gear 131. When the transmitting disk 5 causes oscillating piece 6 to oscillate, actuating rod 64 will be correspondingly displaced. This displacement of the actuating rod will cause the sectoral gear to pivot due to the interengagement between the outer end of the actuating rod and the pins 134 on the sectoral gear. As gear 131 pivots it will cause rotation of the gear assembly 132 in the direction shown by the arrows in FIG. 6. Since the gear assembly has a gear pinned to side door 13 by pin 133, pivoting movement of the sectoral gear 131 will cause the side door 13 to open or close with respect to the housing.

A top cover 11 having a lower portion 12 is vertically movably mounted on housing 1 pivotally connecting therein a crank 71 contactingly mounted between top cover 11 and a cam 7 secured to the center of transmitting disk 5 in the manner that when disk 5 rotates, cover 11 will vertically reciprocate.

Housing 1 mounts therein a mounting plate 81 having a vertical groove 812 and a mounting frame 811 for mounting thereon elevating mechanism 8 having a pin 82 which is slidably guided in groove 812 and mechanically coupled to second hollow end 63 so that when oscillating piece 6 oscillates, elevating mechanism 8 will vertically translate housing 1. Elevating mechanism 8 further includes a base 83 fixedly mounting therein a shaft 831 coaxially securing thereto a top gear 832 capable of meshing with gear assembly 3 to rotate housing 1 with respect to base 83 when housing 1 is elevated to an uppermost position.

Housing 1 rotatably mounts therein a geared shaft having a bottom end gear 84 capable of meshing with top gear 832 when housing 1 is in the uppermost position, and a top end gear meshing with a tubular member 851 electrically mounted between an illuminating medium 85 having a bulb 852 and an electrical source capable of energizing bulb 852 in the manner that when tubular member 851 is rotated, bulb 852 will intermittently illuminate.

Through the above description, it should now become readily apparent how and why the present invention can achieve the object it contemplates.

I claim:

1. A grounded turning and elevating toy flying saucer comprising a housing, a prime mover mounted in said housing, a reduction gear assembly drivingly connected to said prime mover, turning mechanism mounted in said housing and drivingly connected to said reduction gear assembly for turning said housing, a transmitting disc mounted in said housing and being drivingly connected to said reduction gear assembly, said transmitting disc having thereon an irregular groove, a slider slidably received in said groove, an oscillating piece connected to said slider, said oscillating piece having a first end pivotably connected to said housing, and elevating mechanism for elevating said housing, said oscillating piece having a second opposite end mechanically coupled to said elevating mechanism for elevating said housing upon movement of said oscillating piece.

2. A toy flying saucer according to claim 1, further comprising:

an openable side door formed on said housing;

a gear train mounted in said housing and mechanically coupled to said side door; and an actuating rod mechanically coupled to said prime gear train and to said oscillating piece in a manner that when said oscillating piece is caused to oscillate by said mover, said actuating rod can open and/or close said side door.

3. A toy flying saucer according to claim 1, further comprising:

a top cover vertically movably mounted on said housing;

a cam securely fixed to a center of said transmitting disk; and a crank pivotally connected to said housing and respectively contacting with and mounted between said top cover and said cam in a manner that when said disk rotates, said cover will vertically move.

4. A toy flying saucer according to claim 1, further comprising:

a mounting plate mounted in said housing and having a vertical groove;

a pin secured to said elevating mechanism and being slidably guided in said vertical groove, said pin being mechanically coupled to said second opposite end; and said elevating mechanism including a base, a shaft fixically mounted on said base a top gear secured to said shaft capable of meshing with said gear assembly to rotate said housing with respect to said base when said elevating mechanism elevates said housing to an uppermost position.

5. A toy flying saucer according to claim 1, further comprising:

a geared shaft rotatably mounted in said housing, and having a bottom end gear capable of meshing with said top gear when said housing is in said uppermost position, said geared shaft also having a top end gear;

an illuminating medium mounted in said housing, and electric source electrically connected to said illuminating medium; and a tubular member meshing with said top end gear, and electrically mounted between said illuminating medium and said electric source in a manner that when said tubular member rotates, said illuminating medium will intermittently illuminate.

* * * * *